US006282992B1

(12) United States Patent
Hu

(10) Patent No.: US 6,282,992 B1
(45) Date of Patent: Sep. 4, 2001

(54) BIASING ARRANGEMENT FOR A PAWL OF A REVERSIBLE RATCHET-TYPE WRENCH

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/541,193

(22) Filed: Apr. 3, 2000

(30) Foreign Application Priority Data

Feb. 3, 2000 (TW) ..... 89202280 U

(51) Int. Cl.[7] ..... B25B 13/46
(52) U.S. Cl. ..... 81/63.2; 81/60; 81/63
(58) Field of Search ..... 81/63.2, 63, 63.1, 81/62, 60, 58.4

(56) References Cited

U.S. PATENT DOCUMENTS

| | | | | |
|---|---|---|---|---|
| 893,097 | * | 7/1908 | Reams | 81/63 |
| 1,033,358 | * | 7/1912 | Turner | 81/63 |
| 1,194,471 | * | 8/1916 | Boosinger | 81/60 |
| 1,426,127 | * | 8/1922 | Tuttle | 81/60 |
| 1,957,462 | * | 5/1934 | Kress | 81/63 |
| 2,657,604 | * | 11/1953 | Rues | 81/63.2 |
| 2,957,377 | * | 10/1960 | Hare | 81/63.2 |
| 3,019,682 | * | 2/1962 | Hare | 81/63.2 |
| 3,265,171 | * | 8/1966 | Kilness | 81/63 |
| 3,337,014 | * | 8/1967 | Sandrick | 81/63 |
| 3,393,780 | * | 7/1968 | Kilness | 81/63 |
| 4,796,492 | * | 1/1989 | Liou | 81/58.4 |
| 5,178,047 | * | 1/1993 | Arnold et al. | 81/63.2 |
| 5,425,291 | * | 6/1995 | Chang | 81/60 |
| 5,794,496 | * | 8/1998 | Arnold | 81/63.2 |
| 5,857,390 | * | 1/1999 | Whiteford | 81/62 |
| 5,901,620 | * | 5/1999 | Arnold | 81/60 |
| 5,964,129 | * | 10/1999 | Shiao | 81/63.2 |

FOREIGN PATENT DOCUMENTS

| | | | | |
|---|---|---|---|---|
| 1 559 093 | * | 1/1980 | (GB) | 81/63.2 |

* cited by examiner

*Primary Examiner*—James G. Smith
*Assistant Examiner*—Hadi Shakeri
(74) *Attorney, Agent, or Firm*—Alan Kamrath; Rider, Bennett, Egan & Arundel, LLP

(57) ABSTRACT

A reversible ratchet-type wrench includes a handle and a head extended from the handle and having a hole. A web is defined between the handle and the head, and a cavity is defined in the web and communicated with the hole. The web further includes a compartment having a first end communicated with the cavity and a second end communicated with outside, thereby leaving a bridge in the web. A drive member is rotatably mounted in the hole of the head. A pawl is mounted in the cavity and includes a first side with ratchet teeth for releasably engaging with teeth on an outer periphery of the drive member. A switch member includes a turn-piece for manual operation and an actuating plate extended from the turn-piece and rotatably received in the second end of the compartment of the head. The switch member is switchable between two positions for changing ratcheting direction of the drive member. A biasing arrangement is mounted in the cavity and between the pawl and the actuating plate for biasing the ratchet teeth of the pawl to engage with the teeth of the drive member.

37 Claims, 11 Drawing Sheets

BIASING ARRANGEMENT FOR A PAWL OF A REVERSIBLE RATCHET-TYPE WRENCH

BACKGROUND OF THE INVENTION

1. Field of the Invention

The present invention relates to a biasing arrangement for a pawl of a reversible ratchet-type wrench to provide reliable ratcheting. The present invention also relates to an improved head structure for a ratchet-type wrench to lower the manufacture cost.

2. Description of the Related Art

U.S. Pat. No. 2,957,377 issued to Hare on Oct. 25, 1960 discloses a reversible ratchet type wrench comprising a body 10 having a handle 11 and a head 12. A cap 39 and an annular wall 44 are provided to upper side and lower side of the head 12, respectively. Yet, this increases the assembly time and the manufacture cost and adversely affects the appearance. A shifting lever 35 is retained in place by a spring 33 that is located in a cylindrical opening 34. Nevertheless, formation of the cylindrical opening 34 that extends upward at an incline is relatively difficult. In addition, formation of the cavity 16 having converging straight sides 17, 18 which diverge in the direction of the periphery of rotatable member 14 requires expensive and accurate computer-numeric-control (CNC), which further results in an increase in the cost together with a low production rate. This is why such a reversible ratchet type wrench is hardly seen in the market.

FIGS. 10 and 11 illustrate another conventional ratchet type wrench comprising a handle 12' and a head 11'. The head 11' is machined to form four consecutive compartments for receiving the drive member 20', the pawl 30' and the shifting lever 40', wherein three of the compartments can be formed by cutting, yet the remaining one must be machined by CNC. Further, the resultant head structure is relatively weak and thus has a poor torque-bearing capacity. In addition, the movement of the pawl 30' for changing ratcheting direction is found unreliable, as it is achieved via transmission of the hook end 442' of a spring 44' attached to the shifting lever 40'.

SUMMARY OF THE INVENTION

In accordance with a first aspect of the invention, a reversible ratchet-type wrench comprises:

a handle;

a head extended from the handle and including a hole, a web being defined between the handle and the head, a cavity being defined in the web and communicated with the hole, the web further including a compartment having a first end communicated with the cavity and a second end communicated with outside, thereby leaving a bridge in the web;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member;

a switch member including a turn-piece for manual operation and an actuating plate extended from the turn-piece and rotatably received in the second end of the compartment of the web, the switch member being switchable between two positions for changing ratcheting direction of the drive member; and a biasing means mounted in the cavity and between the pawl and the actuating plate for biasing the ratchet teeth of the pawl to engage with the teeth of the drive member.

An inner periphery defining the hole of the head includes a first annular groove. The outer periphery of the drive member includes a second annular groove. A C-clip is received in the first annular groove and the second annular groove, thereby rotatably retaining the drive member in the head.

The biasing means includes an elastic element and a peg. The pawl further includes a second side with a recess. The peg has a first end movably received in the recess of the pawl and a second end. The elastic element biases the second end of the peg for exerting a force to the peg toward the pawl, thereby urging the ratchet teeth of the pawl to engage with the teeth of the gear wheel.

In an embodiment of the invention, the actuating plate of the switch member includes a receptacle that faces the cavity. The elastic element includes a first end received in the receptacle and a second end outside the receptacle and configured to be attached to the actuating plate. The second end of the peg is received in the elastic element. The first end of the elastic element is configured to bias the second end of the peg toward the recess of the pawl.

In another embodiment of the invention, the actuating plate of the switch member includes a first receptacle that faces the cavity, the first receptacle having a first end wall. The second end of the peg is received in the first receptacle and includes a second receptacle with a second end wall. Two ends of the elastic element are attached between the first end wall and the second end wall.

The drive member may be a gear wheel including an inner periphery for driving a fastener. Alternatively, the drive member includes a drive column for releasably engaging with a socket. The head includes an end wall with an opening, and the drive member includes a stub rotatably received in the opening.

In accordance with a second aspect of the invention, a reversible ratchet-type wrench comprises:

a handle;

a head extended from the handle and including a hole, a web being defined between the handle and the head, a cavity being defined in the web and communicated with the hole, the web further including a compartment communicated with the cavity;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member, the pawl further including a second side with a recess;

a switch member including a turn-piece for manual operation and an actuating plate extended from the turn-piece and rotatably received in the compartment of the web, the switch member being switchable between two positions for changing ratcheting direction of the drive member; and a biasing means mounted in the cavity and between the recess of the pawl and the actuating plate for biasing the ratchet teeth of the pawl to engage with the teeth of the drive member, the biasing means including an elastic element and a peg, the peg having a first end movably received in the recess of the pawl and a second end, the elastic element biasing the second end of the peg for exerting a force to the peg toward the pawl, thereby urging the ratchet teeth of the pawl to engage with the teeth of the gear wheel;

the actuating plate of the switch member including a receptacle that faces the cavity, the elastic element including a first end received in the receptacle and a second end outside the receptacle and configured to be attached to the actuating plate, the second end of the peg being received in the elastic element, the first end of the elastic element being configured to bias the second end of the peg toward the recess of the pawl.

In accordance with a third aspect of the invention, a reversible ratchet-type wrench comprises:

a handle;

a head extended from the handle and including a hole, a web being defined between the handle and the head, a cavity being defined in the web and communicated with the hole, the web further including a compartment communicated with the cavity, a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member, the pawl further including a second side with a recess;

a switch member including a turn-piece for manual operation and an actuating plate extended from the turn-piece and rotatably received in the compartment of the web, the switch member being switchable between two positions for changing ratcheting direction of the drive member; and a biasing means mounted in the cavity and between the recess of the pawl and the actuating plate for biasing the ratchet teeth of the pawl to engage with the teeth of the drive member, the biasing means including an elastic element and a peg, the peg having a first end movably received in the recess of the pawl and a second end, the elastic element biasing the second end of the peg for exerting a force to the peg toward the pawl, thereby urging the ratchet teeth of the pawl to engage with the teeth of the gear wheel;

the actuating plate of the switch member including a first receptacle that faces the cavity, the first receptacle having a first end wall, the second end of the peg being received in the first receptacle and including a second receptacle with a second end wall, the elastic element having two ends that are attached between the first end wall and the second end wall.

In accordance with a fourth aspect of the invention, a reversible ratchet-type wrench comprises:

a handle, a head extended from the handle and including a hole, a web being defined between the handle and the head, a cavity being defined in the web and communicated with the hole, the web further including a compartment communicated with the cavity;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member, the pawl further including a second side with a recess;

a switch member rotatably received in the compartment of the web, the switch member being switchable between two positions for changing ratcheting direction of the drive member; and a biasing means mounted in the cavity and having a first end slidably received in the recess of the pawl and a second end attached to the switch member for biasing the ratchet teeth of the pawl to engage with the teeth of the drive member.

Other objects, advantages and novel features of the invention will become more apparent from the following detailed description when taken in conjunction with the accompanying drawings.

DETAILED DESCRIPTION OF THE PREFERRED EMBODIMENTS

Figure 1:
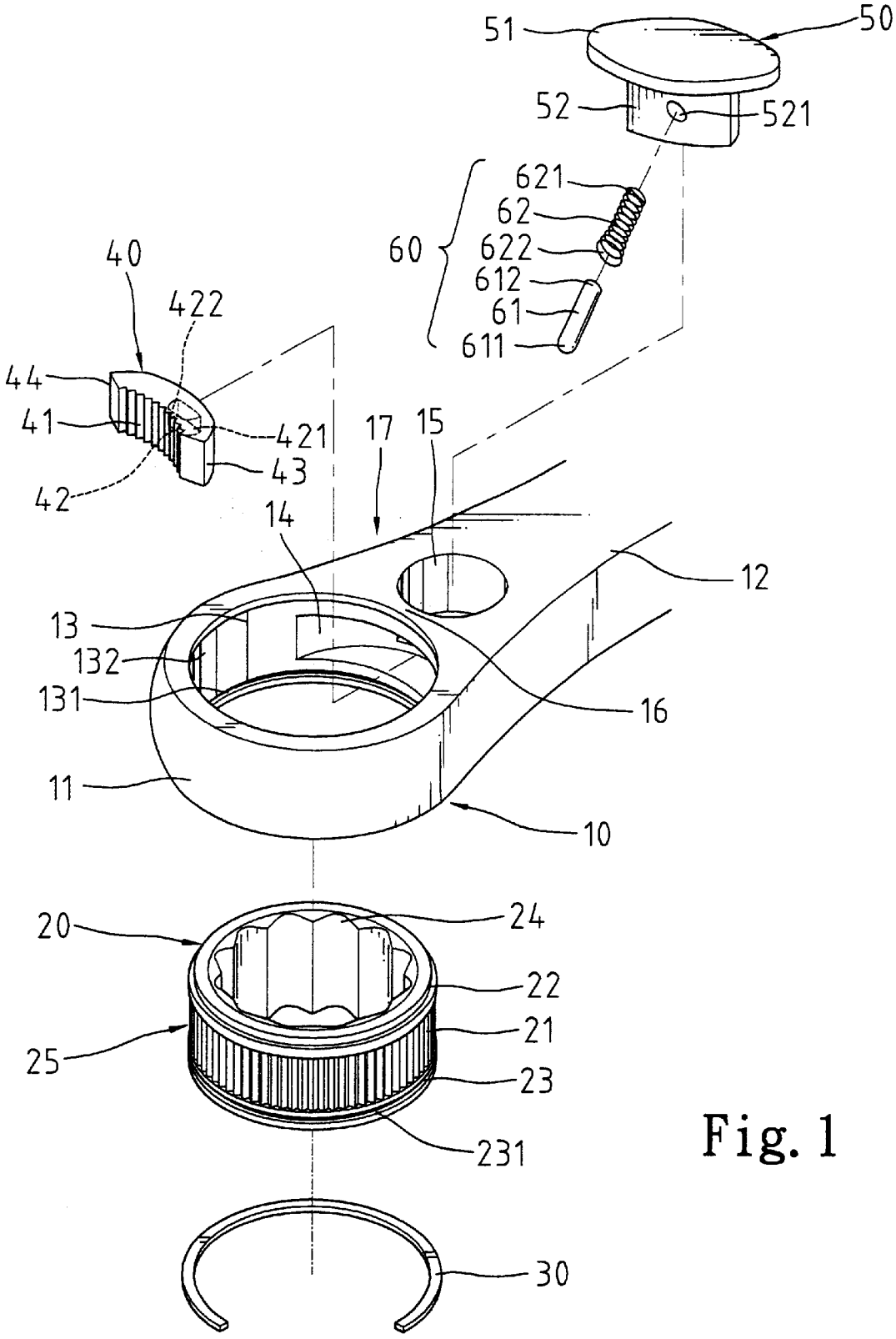
FIG. 1 is an exploded perspective view of an end portion of a first embodiment of a ratchet-type wrench in accordance with the present invention.

Referring to FIGS. 1 through 9 and initially to FIGS. 1, 2, 3, and 6, a ratchet-type wrench 10 in accordance with the present invention generally includes a handle 12 and a head 11 having a hole 13. An inner periphery 132 defining the hole 13 of the head 11 includes an annular groove 131 in a lower portion thereof. A web 17 is defined between the head 11 and the handle 12. A cavity 14 is defined in the web 17. Also defined in the web 17 is a compartment 15 that is substantially L-shape and includes an inner end communicated with the cavity 14 and an outer end communicated with outside, thereby leaving a bridge 16 on the web 17. The outer end of the compartment 15 is preferably circular. The bridge 16 increases the strength of the head 11 and the handle 12, thereby providing a higher torque-bearing capacity.

A drive member (in the form of a gear wheel 20 in this embodiment) is mounted in the head 11 and includes an inner periphery 24 for driving a fastener (not shown) and an outer periphery 25. The outer periphery 25 includes a recessed upper end portion 22, a lower end portion 23, and a middle portion with a plurality of recessed teeth 21. The lower end portion 23 includes an annular groove 231. A C-clip 30 is received in the annular groove 231 of the lower end portion 23 and the annular groove 131 of the head 11, thereby rotatably retaining the gear wheel 20 in the head 11 of the wrench 10, best shown in FIG. 2.

A pawl 40 is mounted in cavity 14 in the web 17 and includes ratchet teeth 41 on a side thereof for engaging with teeth 21 of the gear wheel 20. The other side of the pawl 40 further includes a recess 42 having two ends 421 and 422, which will be described later.

Figure 2:
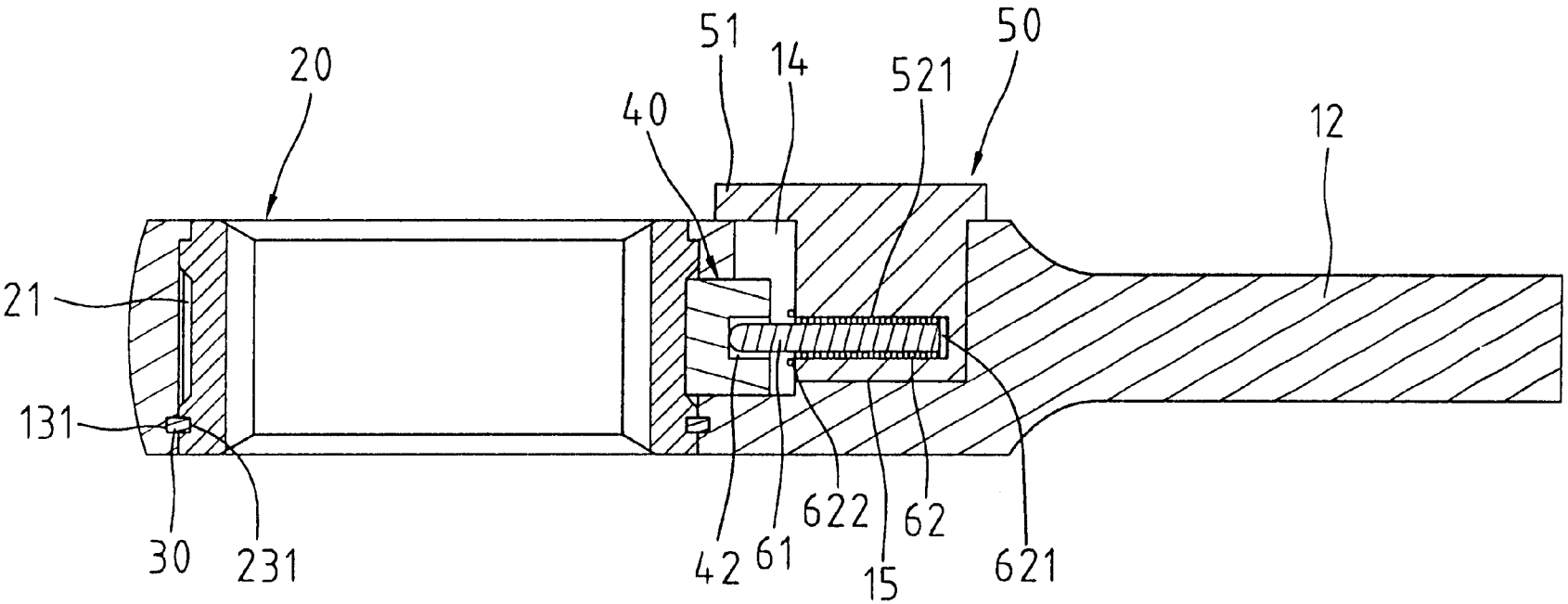
FIG. 2 is a sectional view of the end portion of the first embodiment of the ratchet-type wrench in accordance with the present invention.
Figure 3:
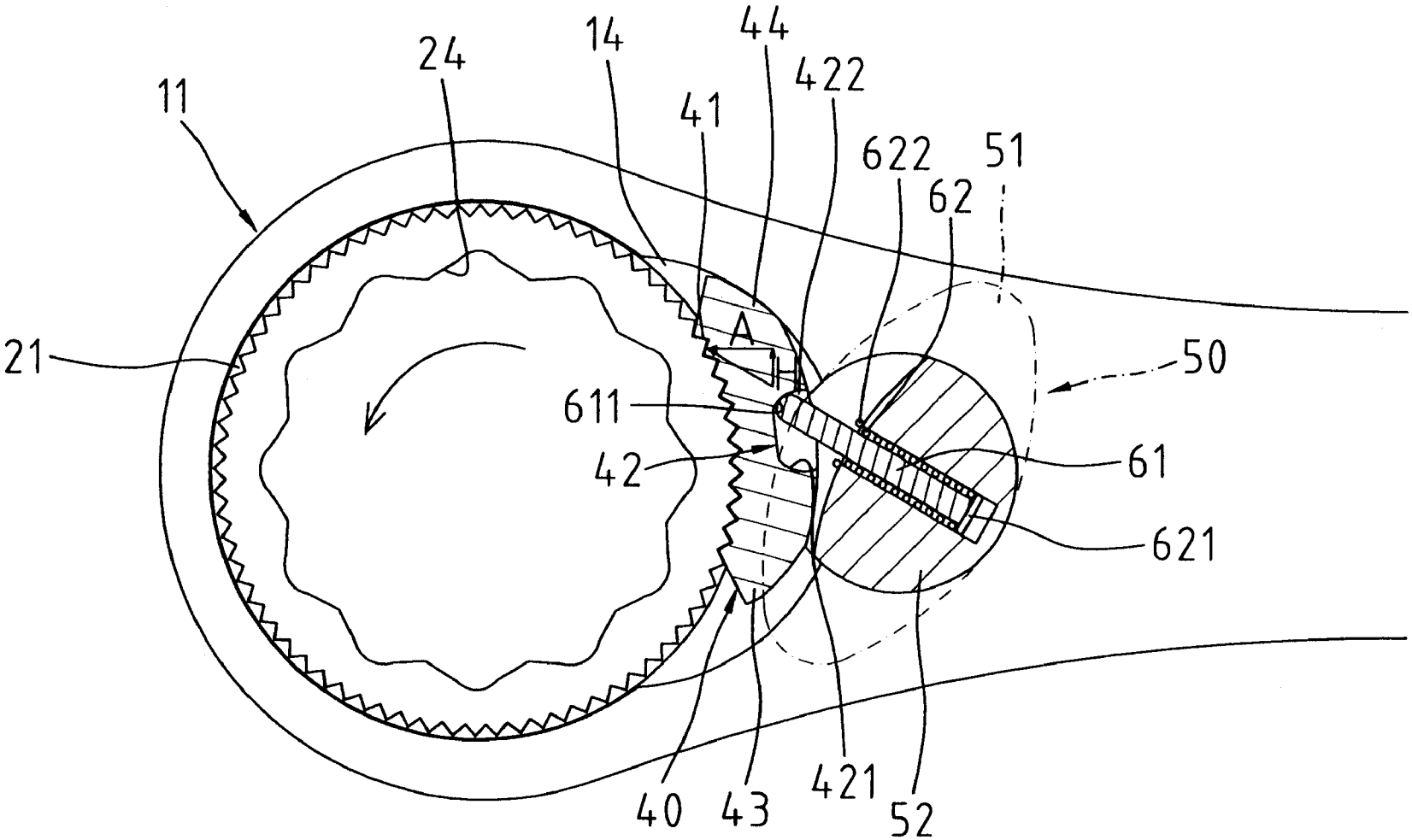
FIG. 3 is a top view, partly sectioned of the end portion of the first embodiment of the ratchet-type wrench in accordance with the present invention, wherein the wrench is in a status allowing counterclockwise ratcheting.

Still referring to FIGS. 1 through 3, a switch member 50 is rotatably mounted to the second end of the compartment 15. In this embodiment, the switch member 50 includes a turn-piece 51 outside the compartment 15 for manual operation and an actuating plate 52 extended from the turn-piece 51 and having a receptacle 521 that faces the cavity 14. A biasing means 60 is mounted in the receptacle 521 and includes an elastic element 62 and a peg 61. In this embodiment as illustrated in FIG. 2, the elastic element 62 includes a first end 621 configured to bias an end 612 of the peg 61. A second end 622 of the elastic element 62 is configured to have a larger diameter so as to bear against and thus be attached to the actuating plate 52 in an area surrounding an opening section (not labeled) of the receptacle 521, as shown in FIG. 3.

In assembly, the switch member 50 is mounted in the compartment 15 and the biasing means 60 is mounted into the receptacle 521 of the switch member 50 via the cavity 14 with the elastic element 62 surrounding a part of the peg 61. The end 612 of the peg 61 bears against the first end 621 of the elastic element 62. The pawl 40 is mounted into the cavity 14 with the other end 611 of the peg 61 extended into the recess 42 of the pawl 40. The C-clip 30 is placed into the hole 13 and the gear wheel 20 is then mounted in the hole 13 with the C-clip 30 received in the annular grooves 131 and 231, thereby completing the assembly. Thus, the assembly procedure is simple and can be accomplished quickly by a C-clip 30 without the aid of any screw or cover.

Figure 4:
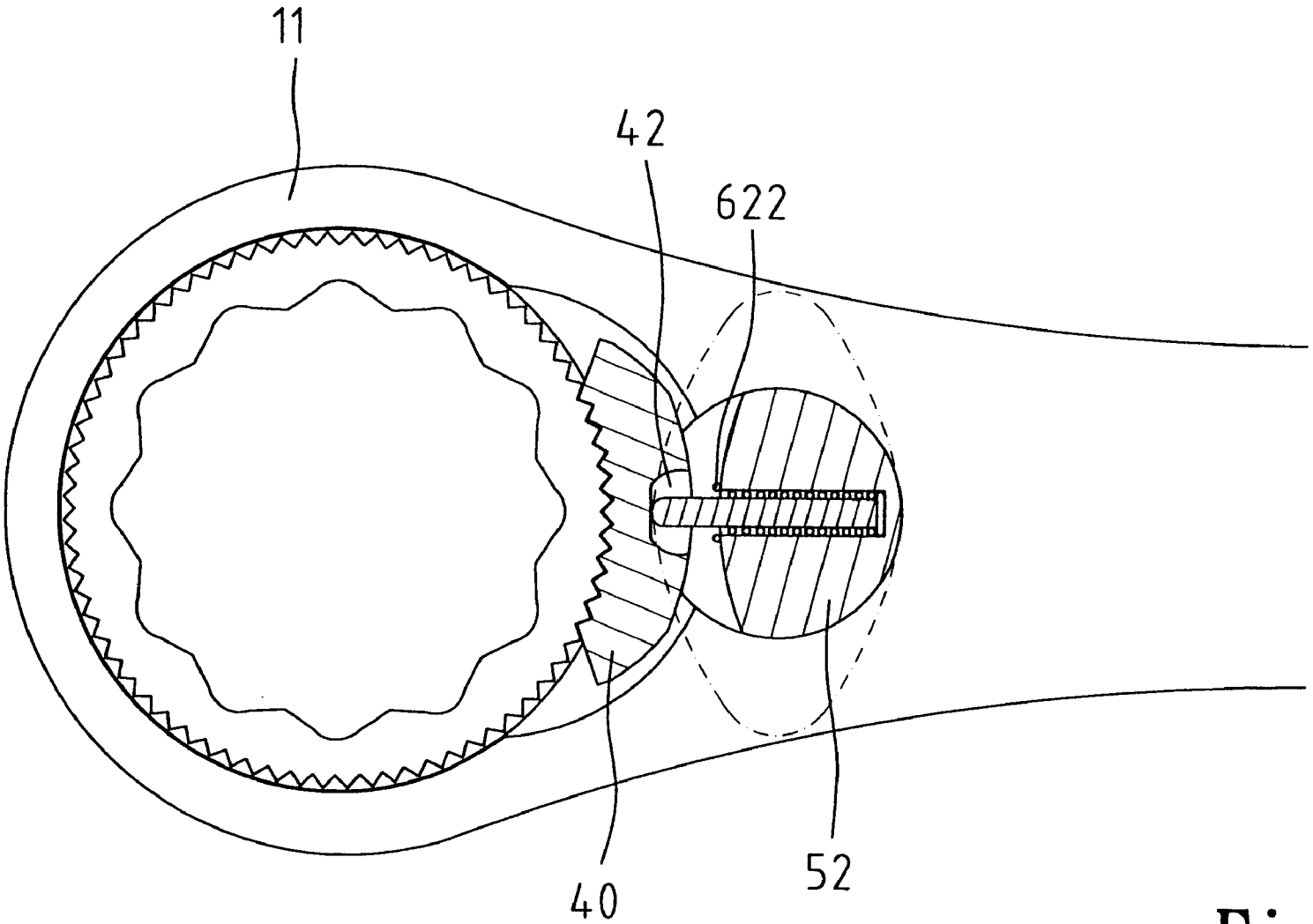
FIG. 4 is a view similar to FIG. 3, wherein the wrench is in a status allowing free rotation in both directions.
Figure 5:
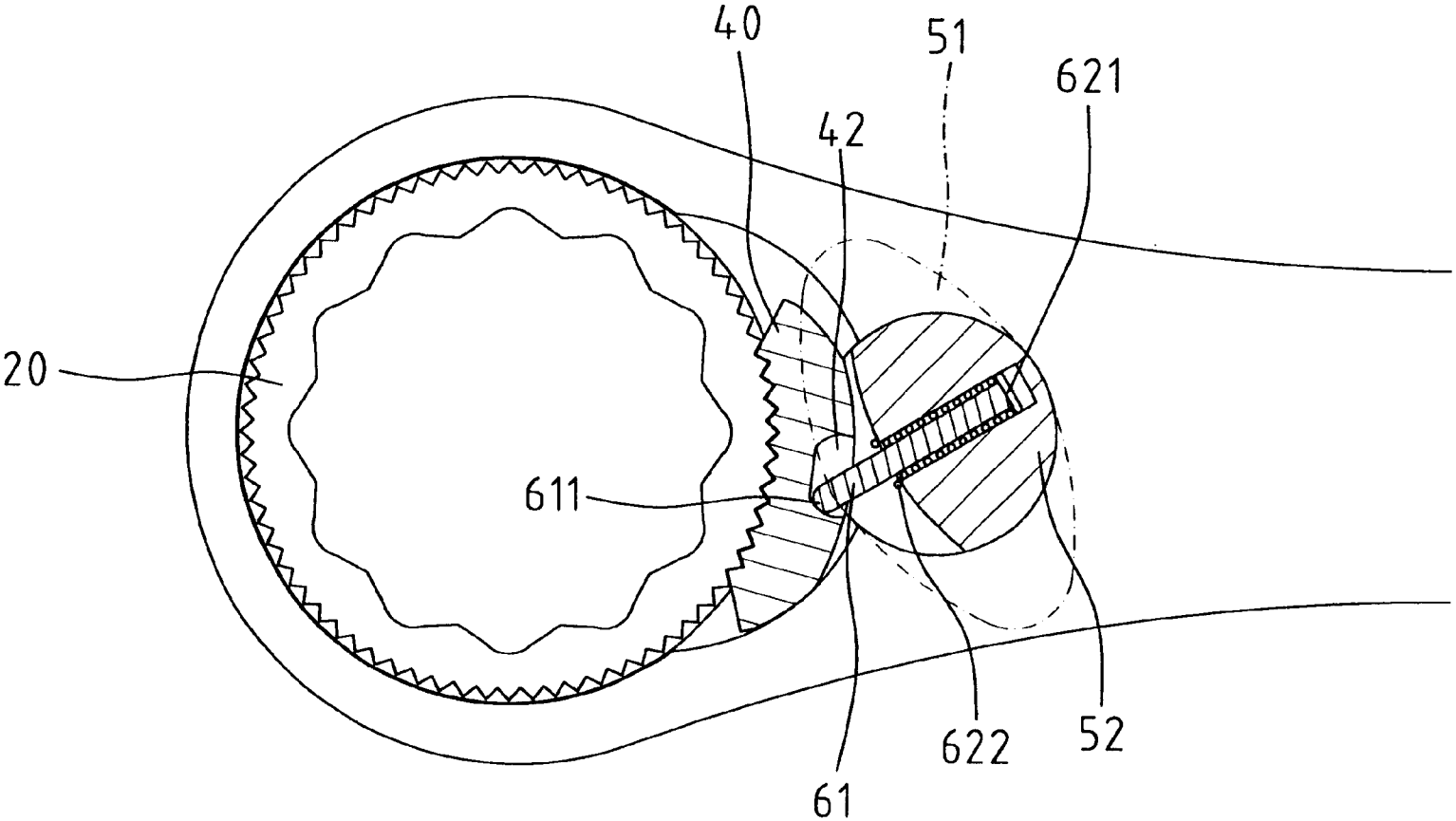
FIG. 5 is a view similar to FIG. 3. wherein the wrench is in a status allowing clockwise ratcheting.
Figure 6:
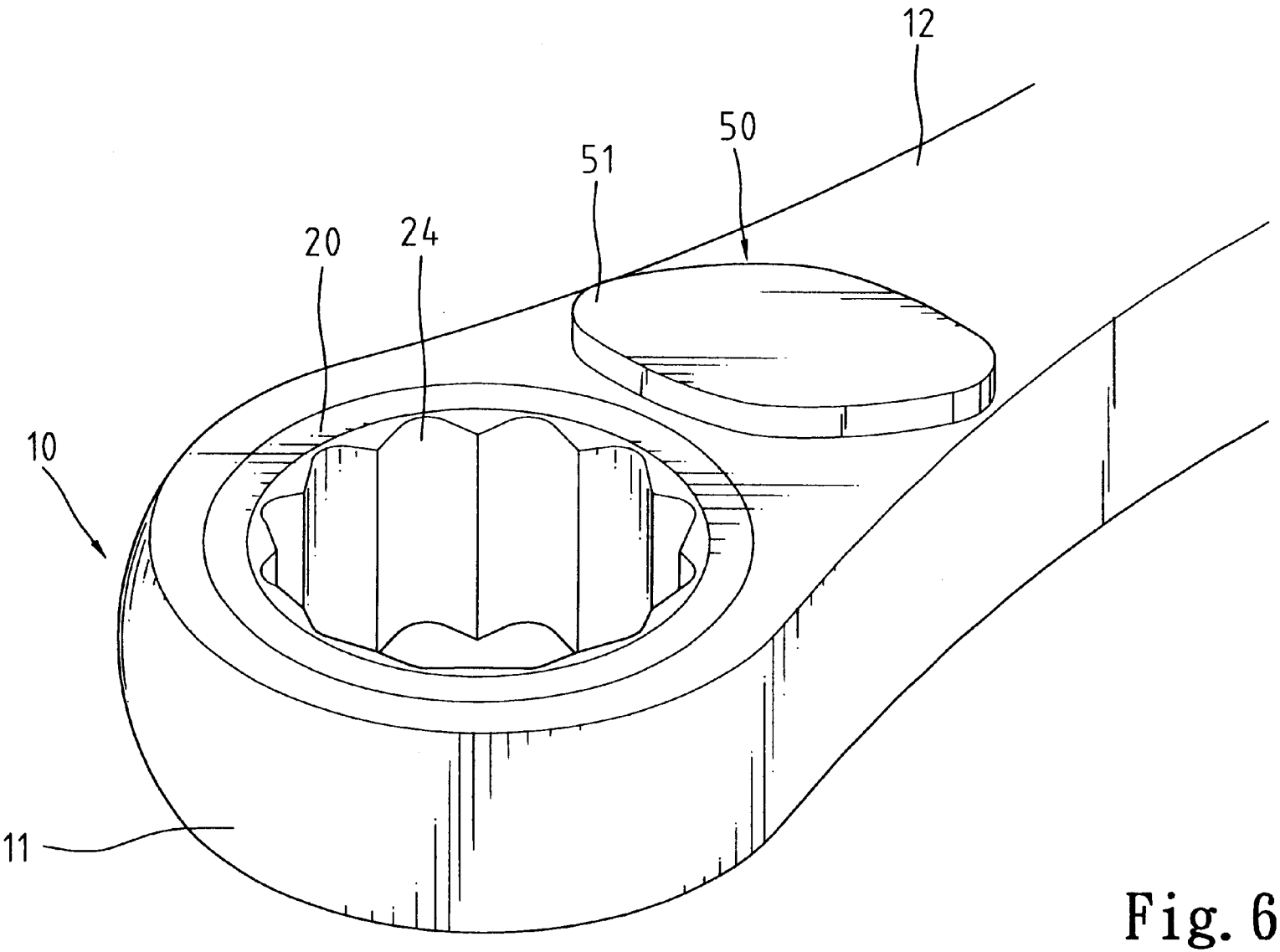
FIG. 6 is a perspective view of the end portion of the first embodiment of the ratchet-type wrench in accordance with the present invention.

The ratchet-type wrench in FIG. 3 is in a status allowing counterclockwise ratcheting (free rotation in clockwise direction), in which the other end 611 of the peg 61 bears against an end 422 of the recess 42 of the pawl 40, and an end 44 of the pawl 40 bears against a wall portion defining the cavity 14. When a change in the ratcheting direction is required, the user may switch the turn-piece 51 and thus cause the biasing means 60 to move. FIG. 4 shows a transition position for the ratchet-type wrench that allows free rotation in both directions. As illustrated in FIG. 4, the elastic element 62 is stretched during rotational movement of the turn-piece. When the turn-piece 51 reaches its predetermined position shown in FIG. 5, the other end 611 of the peg 61 bears against the other end 421 of the recess 42 of the pawl 40, and the other end 43 of the pawl 40 bears against another wall portion defining the cavity 14. Thus, the ratchet-type wrench is in a status allowing clockwise ratcheting and free rotation in the counterclockwise direction.

Figure 7:
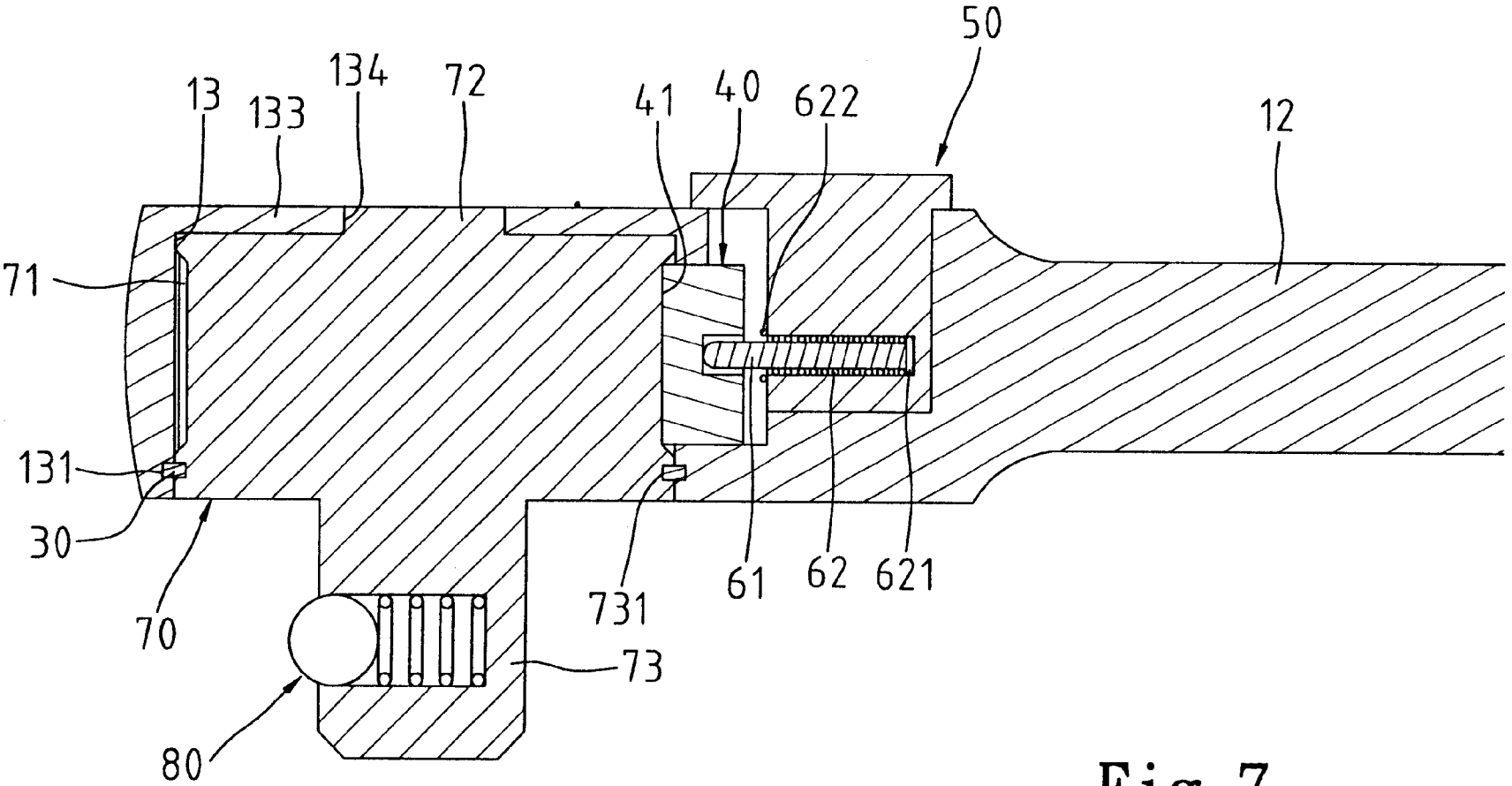
FIG. 7 is a sectional view illustrating a second embodiment of the ratchet-type wrench in accordance with the present invention.

FIG. 7 illustrates a second embodiment in accordance with the present invention, wherein the gear wheel 20 is replaced by a drive member 70 having a drive column 73 with an engaging means 80 for releasably engaging with a socket (not shown). The drive member 70 includes an outer periphery having a plurality of teeth 71 for engaging with the ratchet teeth 41. An annular groove 731 is defined in a lower portion of the outer periphery of the drive member 70 for engaging with the C-clip 30, which is identical to that disclosed above. In addition, the drive member 70 includes a stub 72 on top thereof, and the upper portion of the head 11 is modified to include an end wall 133 with an opening 134 for rotatably receiving the stub 72 of the drive member 70, thereby providing stable rotational movement for the drive member 70.

Figure 8:
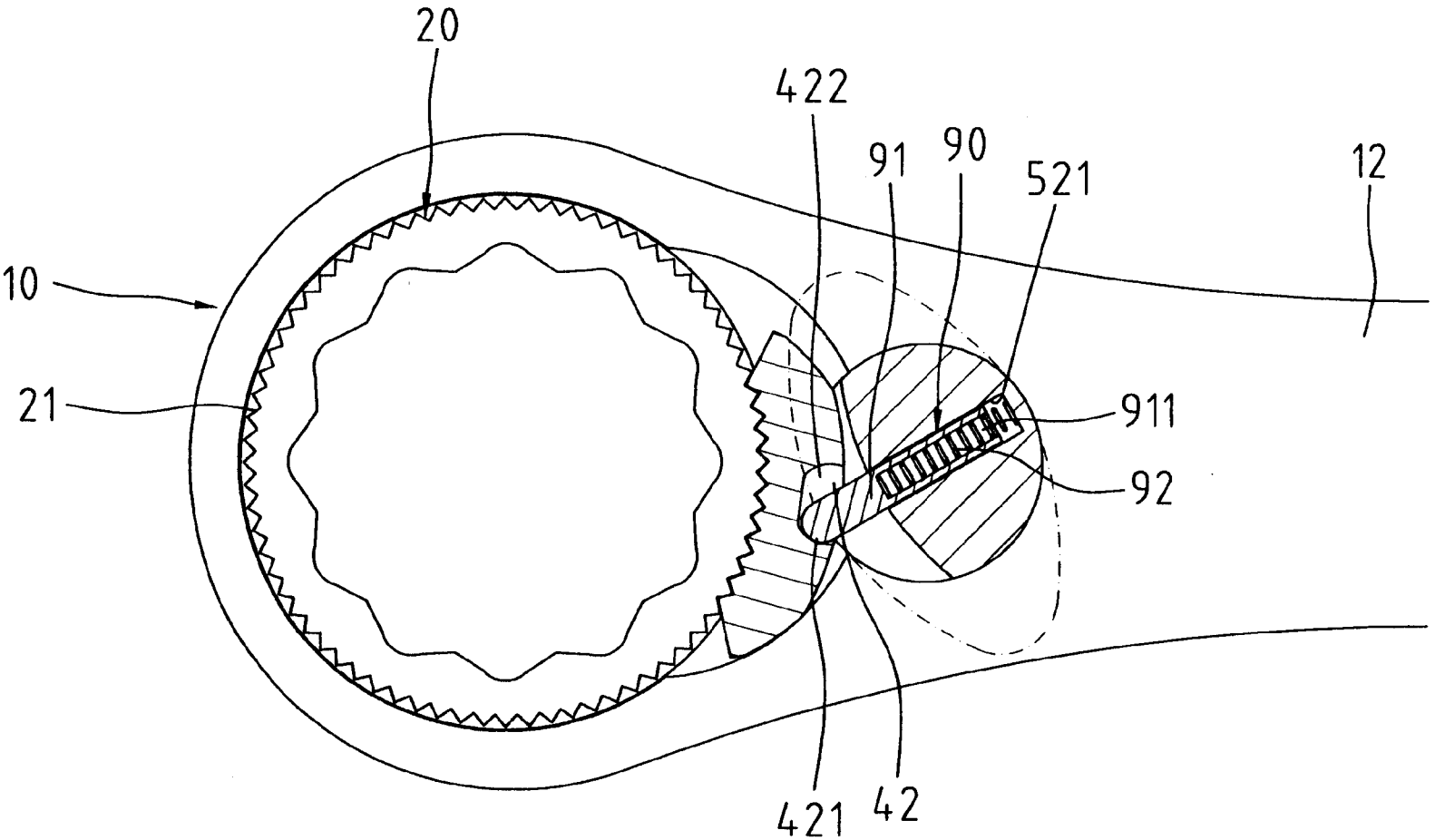
FIG. 8 is a top view of an end portion of a third embodiment of the ratchet-type wrench in accordance with the present invention.

FIG. 8 illustrates a third embodiment in accordance with the present invention. It is noted that the biasing means (now designated by 90) in this embodiment includes a pin 91 having a receptacle 911 for receiving an end of the elastic element 92. Thus, the elastic element 92 is attached between an end wall (not labeled) defining the receptacle 911 of the pin 91 and an end wall (not labeled) defining the receptacle 521 of the switch member 50.

Figure 9:
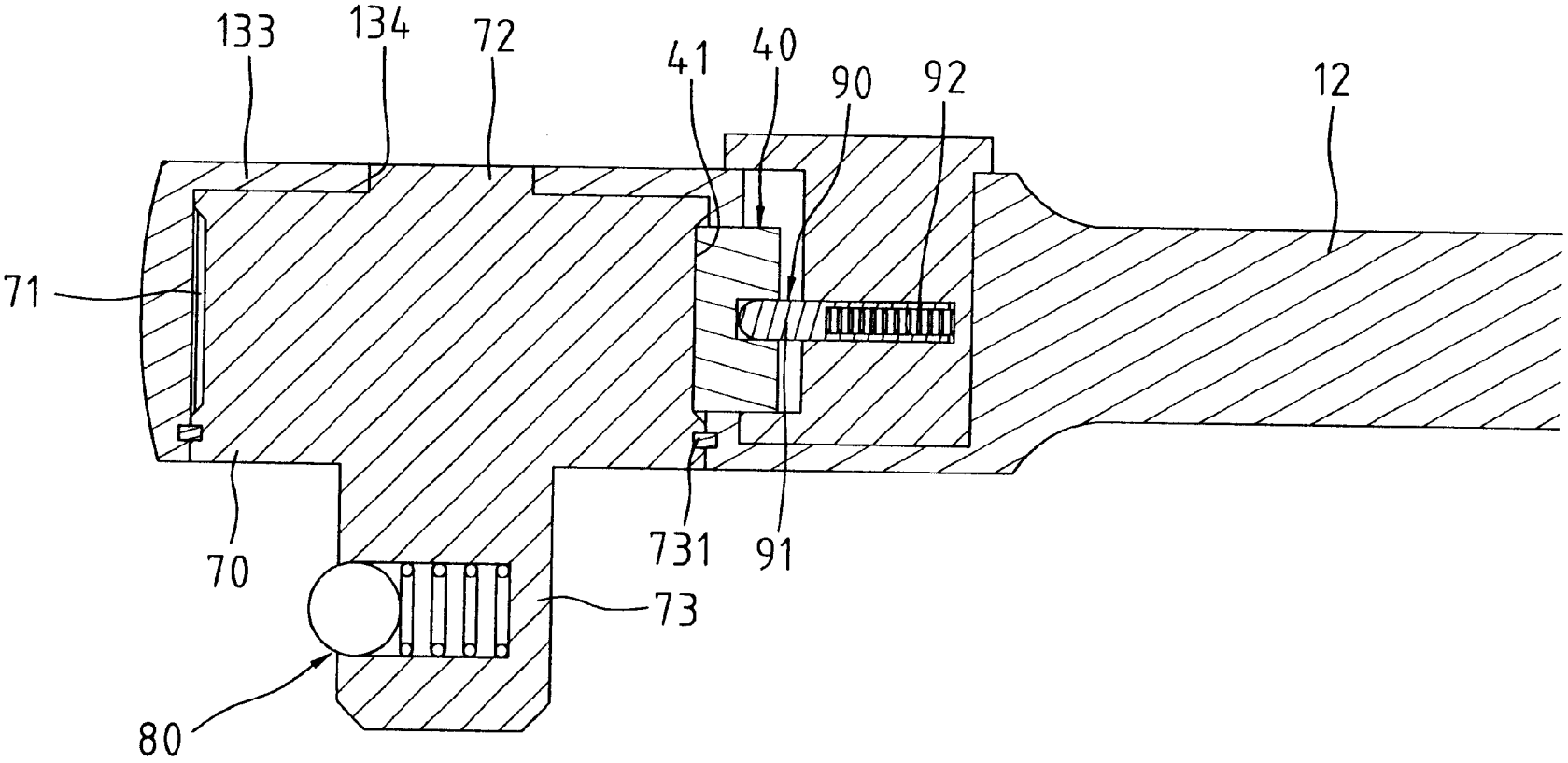
FIG. 9 is a sectional view illustrating a fourth embodiment of the ratchet-type wrench in accordance with the present invention.
Figure 10:
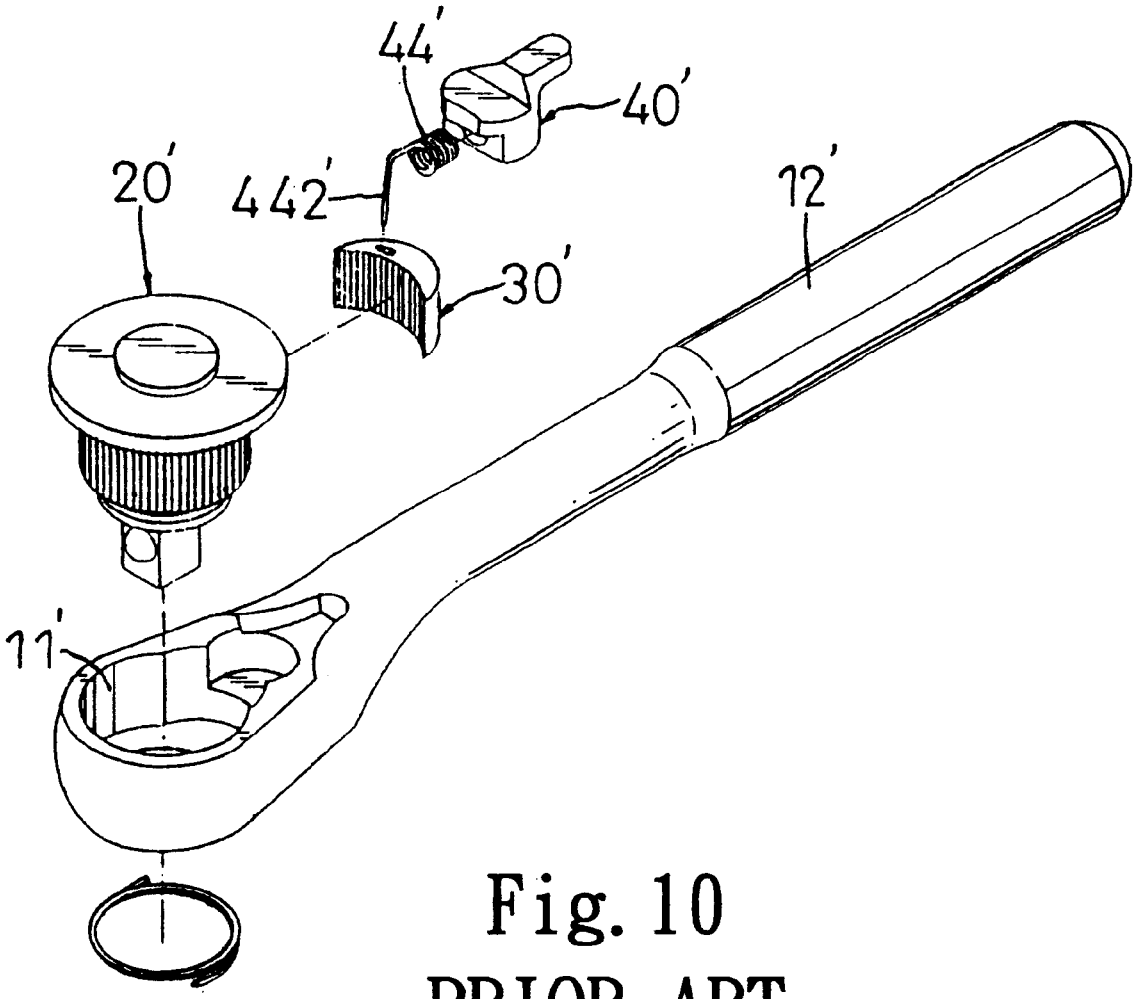
Fig. 10 PRIOR ART
FIG. 10 is an exploded perspective view of a conventional ratchet type wrench.
Figure 11:
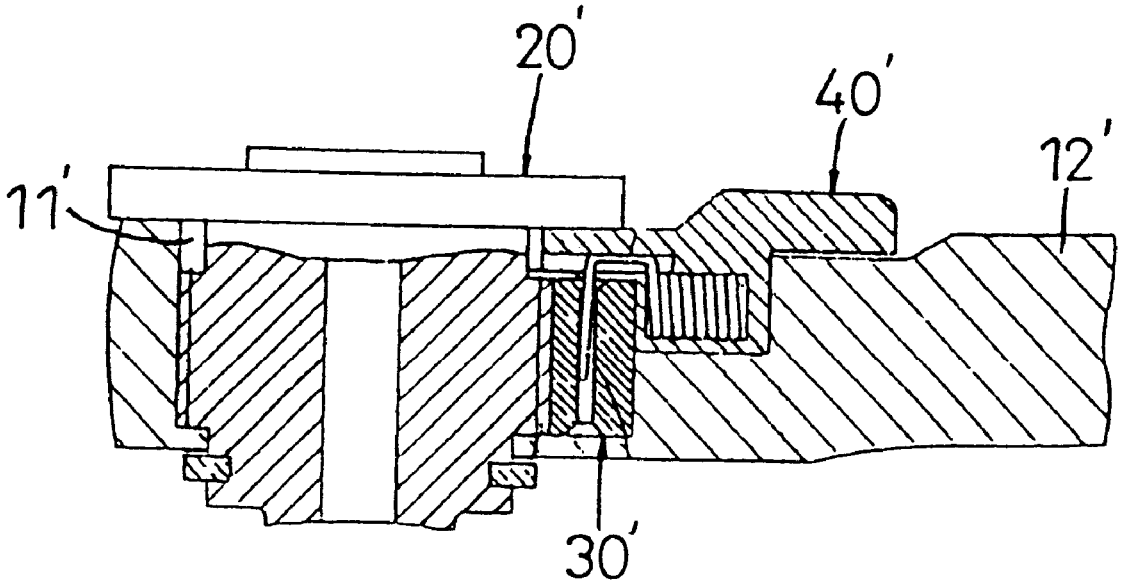
Fig. 11 PRIOR ART
FIG. 11 is a sectional view of a head portion of the conventional ratchet type wrench in FIG. 10.

FIG. 9 illustrates a fourth embodiment in accordance with the present invention. It is noted that the biasing means 90 in the fourth embodiment is identical to that of the third embodiment, and the drive member 70 in the fourth embodiment is identical to that of the second embodiment.

Although the invention has been explained in relation to its preferred embodiment, it is to be understood that many other possible modifications and variations can be made without departing from the spirit and scope of the invention as hereinafter claimed.

What is claimed is:

1. A reversible ratchet-type wrench comprising:

a handle;

a head extended from the handle and including a hole, a web being defined between the handle and the head, a cavity being defined in the web and communicated with the hole, the web further including a compartment having a first end communicated with the cavity and a second end communicated with outside, thereby leaving a bridge in the web;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member;

a switch member including a turn-piece for manual operation and an actuating plate extended from the turn-piece and rotatably received in the second end of the compartment of the web, the switch member being switchable between two positions for changing ratcheting direction of the drive member;

an elastic element and a peg mounted in the cavity and between the pawl and the actuating plate, with the peg being received in the elastic element and in the receptacle, with the peg and the elastic element being rotatable with the actuating plate, the pawl further including a second side with a recess, the peg having a first end movably received in the recess of the pawl and a second end, the elastic element biasing the second end of the peg for exerting a force to the peg toward the pawl, thereby urging the ratchet teeth of the pawl to engage with the teeth of the drive member, wherein the elastic element includes a first end received in the receptacle and a second end outside the receptacle and configured to be attached to the actuating plate, the second end of the peg being received in the elastic element, the first end of the elastic element being configured to bias the second end of the peg toward the recess of the pawl by having the elastic element under tension between the receptacle and the peg;

wherein an inner periphery defining the hole of the head includes a first annular groove, and wherein the outer periphery of the drive member includes a second annular groove; and a C-clip received in the first annular groove and the second annular groove, thereby rotatably retaining the drive member in the head.

2. The reversible ratchet-type wrench as claimed in claim 1, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive member includes a drive column for releasably engaging with a socket and extending beyond the first face.

3. The reversible ratchet-type wrench as claimed in claim 1, wherein the receptacle has a first end wall, the second end of the peg being received in the receptacle and including another receptacle with a second end wall, the elastic element having two ends that are attached between the first end wall and the second end wall.

4. The reversible ratchet-type wrench as claimed in claim 3, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive member includes a drive column for releasably engaging with a socket and extending beyond the first face.

5. The reversible ratchet-type wrench as claimed in claim 1, wherein the drive member is a gear wheel including an inner periphery adapted to drive a fastener.

6. The reversible ratchet-type wrench as claimed in claim 1, wherein the drive member includes a drive column for releasably engaging with a socket.

7. The reversible ratchet-type wrench as claimed in claim 6, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive column extends beyond the first face.

8. The reversible ratchet-type wrench as claimed in claim 1, wherein the drive member includes a top and a bottom, with the outer periphery extending between the top and the bottom, with the second annular groove being spaced from the top and the bottom.

9. A reversible ratchet-type wrench comprising:

a drive member including a plurality of teeth formed on a periphery thereof;

a pawl including a first side with a plurality of ratchet teeth for releasably engaging with the teeth of the drive member, the pawl further including a second side with a recess;

a rotatable switch member including a turn-piece for manual operation and an actuating plate extended from the turn-piece, the switch member being switchable between two positions for changing ratcheting direction of the drive member; and a biasing means between the recess of the pawl and the actuating plate for biasing the ratchet teeth of the pawl to engage with the teeth of the drive member, the biasing means including an elastic element and a peg, the peg having a first end movably received in the recess of the pawl and a second end, the elastic element biasing the second end of the peg for exerting a force to the peg toward the pawl, thereby urging the ratchet teeth of the pawl to engage with the teeth of the gear wheel;

the actuating plate of the switch member including a receptacle, the elastic element including a first end received in the receptacle and a second end outside the receptacle and configured to be attached to the actuating plate, the second end of the peg being received in the elastic element, the first end of the elastic element being configured to bias the second end of the peg toward the recess of the pawl by having the elastic element under tension between the receptacle and the peg.

10. The reversible ratchet-type wrench as claimed in claim 9, wherein the drive member is rotatable and the plurality of teeth are formed on an outer periphery of the drive member.

11. The reversible ratchet-type wrench as claimed in claim 10, further comprising:

a handle; and a head extended from the handle and including a hole, a web being defined between the handle and the head, a cavity being defined in the web and communicated with the hole, the web further including a compartment communicated with the cavity, with the drive member being rotatably mounted in the hole of the head, with the pawl mounted in the cavity, with the switch member being rotatably received in the compartment of the web, with the biasing means mounted in the cavity, and with the receptacle facing the cavity.

12. The reversible ratchet-type wrench as claimed in claim 11, wherein the drive member is a gear wheel including an inner periphery adapted to drive a fastener.

13. The reversible ratchet-type wrench as claimed in claim 11, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive member includes a drive column for releasably engaging with a socket and extending beyond the first face.

14. The reversible ratchet-type wrench as claimed in claim 11, wherein an inner periphery defining the hole of the head includes a first annular groove, and wherein the outer periphery of the drive member includes a second annular groove further comprising a C-clip received in the first annular groove and the second annular groove, thereby rotatably retaining the drive member in the head.

15. The reversible ratchet-type wrench as claimed in claim 14, wherein the drive member includes a top and a bottom, with the outer periphery extending between the top and the bottom, with the second annular groove being spaced from the top and the bottom.

16. The reversible ratchet-type wrench as claimed in claim 11, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

17. A reversible ratchet-type wrench comprising:

a handle;

a head extended from the handle and including a hole, a web being defined between the handle and the head, a cavity being defined in the web and communicated with the hole, the web further including a compartment communicated with the cavity;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member, the pawl further including a second side with a recess;

a switch member including a turn-piece for manual operation and an actuating plate extended from the turn-piece and rotatably received in the compartment of the web, the switch member being switchable between two positions for changing ratcheting direction of the drive member, wherein the actuating plate of the switch member includes a first receptacle that faces the cavity; and a biasing means mounted in the cavity and between the recess of the pawl and the actuating plate for biasing the ratchet teeth of the pawl to engage with the teeth of the drive member, the biasing means including an elastic element and a peg, with the peg being received in the elastic element and in the first receptacle, with the peg and the elastic element being rotatable with the actuating plate, the peg having a first end movably received in the recess of the pawl and a second end, the elastic element biasing the second end of the peg for exerting a force to the peg toward the pawl, thereby urging the ratchet teeth of the pawl to engage with the teeth of the gear wheel;

the first receptacle having a first end wall, the second end of the peg being received in the first receptacle and including a second receptacle with a second end wall, the elastic element having two ends that are attached between the first end wall and the second end wall.

18. The reversible ratchet-type wrench as claimed in claim 17, wherein the drive member is a gear wheel including an inner periphery adapted to drive a fastener.

19. The reversible ratchet-type wrench as claimed in claim 17, wherein the head includes a first face and a second face, with the hole extending from the first face towards but spaced from the second face, an integral end wall being defined in the head between the second face and the hole, an opening, being defined in the integral end wall extending between the second face and the hole and having a smaller diameter than and concentrically within the hole, wherein the drive member includes a stub rotatably received in the opening, and wherein the drive member includes a drive column for releasably engaging with a socket and extending beyond the first face.

20. The reversible ratchet-type wrench as claimed in claim 17, wherein an inner periphery defining the hole of the head includes a first annular groove, and wherein the outer periphery of the drive member includes a second annular groove, further comprising a C-clip received in the first annular groove and the second annular groove, thereby rotatably retaining the drive member in the head.

21. The reversible ratchet-type wrench as claimed in claim 20, wherein the drive member includes a top and a bottom, with the outer periphery extending between the top and the bottom, with the second annular groove being spaced from the top and the bottom.

22. The reversible ratchet-type wrench as claimed in claim 17, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

23. A reversible ratchet-type wrench comprising:

a handle;

a head extended from the handle and including a hole, a web being defined between the handle and the head, a cavity being defined in the web and communicated with the hole, the web further including a compartment communicated with the cavity;

a drive member rotatably mounted in the hole of the head, the drive member including a plurality of teeth formed on an outer periphery thereof;

a pawl mounted in the cavity and including a first side with a plurality of ratchet teeth for releasably engaging with the teeth of the drive member, the pawl further including a second side with a recess;

a switch member rotatably received in the compartment of the web, the switch member being switchable between two positions for changing ratcheting direction of the drive member;

a biasing means mounted in the cavity and having a first end slidably received in the recess of the pawl and a second end attached to the switch member for biasing the ratchet teeth of the pawl to engage with the teeth of the drive member; wherein the switch member includes a turn-piece for manual operation and an actuating plate extended from the turn-piece and rotatably received in the compartment of the web, the actuating plate of the switch member includes a receptacle that faces the cavity, wherein the biasing means includes an elastic element and a peg, with the peg being received in the elastic element and in the receptacle, with the peg and the elastic element being rotatable with the actuating plate, the peg having a first end movably received in the recess of the pawl and a second end, the elastic element biasing the second end of the peg for exerting a force to the peg toward the pawl, thereby urging the ratchet teeth of the pawl to engage with the teeth of the gear wheel;

wherein an inner periphery defining the hole of the head includes a first annular groove, and wherein the outer periphery of the drive member includes a second annular groove; and a C-clip received in a first annular groove and the second annular groove, thereby rotatably retaining the drive member in the head.

24. The reversible ratchet-type wrench as claimed in claim 23, wherein the elastic element includes a first end received in the receptacle and a second end outside the receptacle and configured to be attached to the actuating plate, the second end of the peg being received in the elastic element, the first end of the elastic element being configured to bias the second end of the peg toward the recess of the pawl by having the elastic element under tension between the receptacle and the peg.

25. The reversible ratchet-type wrench as claimed in claim 24, wherein the drive member is a gear wheel including an inner periphery adapted to drive a fastener.

26. The reversible ratchet-type wrench as claimed in claim 24, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive member includes a drive column for releasably engaging with a socket and extending beyond the first face.

27. The reversible ratchet-type wrench as claimed in claim 24, wherein the actuating plate of the switch member includes a first receptacle that faces the cavity, the first receptacle having a first end wall, the second end of the peg being received in the first receptacle and including a second receptacle with a second end wall, the elastic element having two ends that are attached between the first end wall and the second end wall.

28. The reversible ratchet-type wrench as claimed in claim 24, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

29. The reversible ratchet-type wrench as claimed in claim 23, wherein the drive member is a gear wheel including an inner periphery adapted to drive a fastener.

30. The reversible ratchet-type wrench as claimed in claim 23, wherein the drive member includes a drive column for releasably engaging with a socket.

31. The reversible ratchet-type wrench as claimed in claim 30, wherein the head includes a first face and a second face, with the hole extending from the first face towards but spaced from the second face, an integral end wall being defined in the head between the second face and the hole, an opening being defined in the integral end wall extending between the second face and the hole and having a smaller diameter than and concentrically within the hole, wherein the drive member includes a stub rotatably received in the opening, and wherein the drive column extends beyond the first face.

32. The reversible ratchet-type wrench as claimed in claim 23, wherein the web includes a first face and a second face, with the cavity formed in the web and located between and spaced from the first and second faces, with the cavity including an arcuate wall extending from intersecting points with the hole and generally perpendicular to the first and second faces and including planar ends extending generally parallel to and spaced from the first and second faces, with first and second end wall sections being defined between the planar ends and the first and second faces and between the arcuate wall and the hole and being integral with the web, with the arcuate wall having a radius from a center and less than that of the hole, with the center of the arcuate wall located in the hole and with the intersecting points being spaced less than two times the radius, wherein the compartment of the web extends from the second face towards but spaced from the first face and has a first end communicated with the cavity and a second end communicated with outside at the second face, thereby leaving an integral bridge in the second end wall section of the web.

33. The reversible ratchet-type wrench as claimed in claim 23, wherein the drive member includes a top and a bottom, with the outer periphery extending between the top and the bottom, with the second annular groove being spaced from the top and the bottom.

34. A head for a ratcheting tool with a handle, a web being defined between the head and the handle, the head comprising a hole extending from a first face towards but spaced from a second face, an integral end wall being defined in the head between the second face and the hole, an opening being defined in the integral end wall extending between the second face and the hole and having a smaller diameter than and concentrically within the hole, a cavity being defined in the web between and spaced from the first and second faces and communicated with the hole, with the cavity including planar ends extending generally parallel to and spaced from the first and second faces, with first and second wall sections being defined between the planar ends and the first and second faces and being integral with the web, the web further comprising a compartment extending from the second face towards but spaced from the first face and having a first end communicated with the cavity and a second end communicated with outside at the second face, thereby leaving an integral bridge in the second end wall section of the web at the second face and located between the hole of the head and the second end of the compartment.

35. The ratcheting tool head as claimed in claim 34, wherein the cavity further includes an arcuate wall extending from intersecting points with the hole and generally perpendicular to the first and second faces, with the first and second end wall sections being defined between the arcuate wall and the hole, with the arcuate wall having a radius from a center and less than that of the hole, with the center of the arcuate wall located in the hole and with the intersecting points being spaced less than two times the radius.

36. The ratcheting tool head as claimed in claim 35, further comprising:

a drive member rotatably mounted in the hole and including a drive column extending from the hole beyond the first face and for releasably engaging with a socket, with the drive member further including a stub rotatably received in the opening in the integral end wall.

37. The ratcheting tool head as claimed in claim 36, further comprising:

a first annular groove included in an inner periphery defining the hole and spaced from the first and second faces, with the drive member including a top from which the stub extends and a bottom from which the drive column extends; a second annular groove included in an outer periphery of the drive member and spaced from the top and the bottom, and a C-clip received in the first annular groove and the second annular groove, thereby rotatably retaining the drive member in the hole.

* * * * *

US006282992C1

(12) EX PARTE REEXAMINATION CERTIFICATE (7342nd)

United States Patent

Hu

(10) Number: US 6,282,992 C1

(45) Certificate Issued: Feb. 2, 2010

(54) BIASING ARRANGEMENT FOR A PAWL OF A REVERSIBLE RATCHET-TYPE WRENCH

(76) Inventor: Bobby Hu, P.O. Box 63-247, Taichung (TW)

Reexamination Request:
No. 90/010,271, Sep. 8, 2008

Reexamination Certificate for:

| | |
|---|---|
| Patent No.: | **6,282,992** |
| Issued: | **Sep. 4, 2001** |
| Appl. No.: | **09/541,193** |
| Filed: | **Apr. 3, 2000** |

(30) Foreign Application Priority Data

Feb. 3, 2000 (TW) ..... 89202280 U

(51) Int. Cl.
*B25B 13/46* (2006.01)

(52) U.S. Cl. ..... 81/63.2; 81/60; 81/63

(58) Field of Classification Search ..... None
See application file for complete search history.

(56) References Cited

U.S. PATENT DOCUMENTS 1,957,462 A 5/1934 Kress
5,857,390 A 1/1999 Whiteford
5,964,129 A 10/1999 Shiao

FOREIGN PATENT DOCUMENTS

JP 11-165271 6/1999
TW 382298 2/2000

*Primary Examiner*—Joseph A. Kaufman

(57) ABSTRACT

A reversible ratchet-type wrench includes a handle and a head extended from the handle and having a hole. A web is defined between the handle and the head, and a cavity is defined in the web and communicated with the hole. The web further includes a compartment having a first end communicated with the cavity and a second end communicated with outside, thereby leaving a bridge in the web. A drive member is rotatably mounted in the hole of the head. A pawl is mounted in the cavity and includes a first side with ratchet teeth for releasably engaging with teeth on an outer periphery of the drive member. A switch member includes a turn-piece for manual operation and an actuating plate extended from the turn-piece and rotatably received in the second end of the compartment of the head. The switch member is switchable between two positions for changing ratcheting direction of the drive member. A biasing arrangement is mounted in the cavity and between the pawl and the actuating plate for biasing the ratchet teeth of the pawl to engage with the teeth of the drive member.

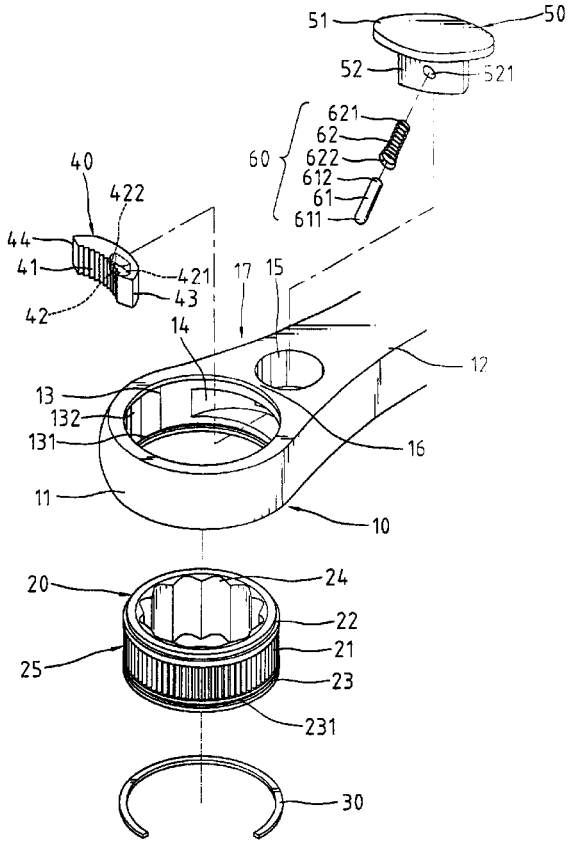

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 1–16, 22, 24–28, 32 and 34–37 is confirmed.

Claims 17–21, 23, 29–31 and 33 are cancelled.

* * * * *